US006969277B2

(12) United States Patent
Shackelford et al.

(10) Patent No.: US 6,969,277 B2
(45) Date of Patent: Nov. 29, 2005

(54) ELECTRICAL INSULATING BANDS

(76) Inventors: Richard A. Shackelford, 8405 Cleveland Massillon Rd., Clinton, OH (US) 44216; John W. Pinney, 4433 Emma St., NW., Canton, OH (US) 44708

( * ) Notice: Subject to any disclaimer, the term of this patent is extended or adjusted under 35 U.S.C. 154(b) by 18 days.

(21) Appl. No.: 10/793,566

(22) Filed: Mar. 4, 2004

(65) Prior Publication Data

US 2005/0075005 A1 Apr. 7, 2005

Related U.S. Application Data

(60) Provisional application No. 60/508,667, filed on Oct. 6, 2003.

(51) Int. Cl.[7] ..... H01R 13/25
(52) U.S. Cl. ..... 439/521
(58) Field of Search ..... 439/521, 271, 439/278, 282, 578, 371, 367, 372, 571, 350, 439/352; 361/42, 45; 174/53, 138, 174, 66; 200/302, 293, 298; 220/241, 212

(56) References Cited

U.S. PATENT DOCUMENTS 2,120,150 A 6/1938 Marshall
2,763,708 A 9/1956 Brennan
2,862,997 A 12/1958 Veitch et al.
3,467,768 A 9/1969 Shorey
3,684,819 A * 8/1972 Wilson ..... 174/53
3,742,123 A 6/1973 Haub, Jr.
3,970,772 A * 7/1976 Ballard ..... 174/53
3,999,340 A 12/1976 Bogese et al.
4,134,636 A * 1/1979 Kleinatland et al. ..... 439/535
4,148,417 A * 4/1979 Simmons ..... 222/94
4,192,352 A 3/1980 Hakamada et al.
4,201,883 A 5/1980 Shepherd
4,267,628 A 5/1981 Izraeli
4,338,970 A 7/1982 Krackeler et al.
4,417,394 A 11/1983 Moody et al.
4,576,428 A 3/1986 DeLuca et al.
4,611,656 A 9/1986 Kendall, Jr. et al.
4,628,145 A 12/1986 Kolcio et al.
4,658,504 A 4/1987 Sinharoy et al.
4,694,283 A 9/1987 Reeb
4,801,783 A 1/1989 Milroy
4,849,580 A 7/1989 Reuter
4,963,700 A 10/1990 Olsen et al.
4,980,798 A 12/1990 Lavene
5,097,526 A 3/1992 Kochsmeier et al.
5,162,617 A 11/1992 Ferbas
5,212,351 A * 5/1993 Raines ..... 174/138 F
5,250,598 A 10/1993 Dornau et al.
5,354,597 A 10/1994 Capik et al.
5,397,243 A 3/1995 MacMurdo, Sr.
5,444,185 A 8/1995 Tanaka
5,549,801 A 8/1996 Perlich et al.
5,648,640 A 7/1997 Osborn
5,705,773 A 1/1998 Smith
5,721,397 A 2/1998 Weinberg
5,753,861 A 5/1998 Hansen et al.
5,796,032 A 8/1998 Hadley
5,831,216 A 11/1998 Hoffmann
5,895,890 A 4/1999 Uchiyama et al.

(Continued)

*Primary Examiner*—Alexander Gilman

(57) ABSTRACT

An electrical insulating band is contiguously formed and is resiliently elastic so that the band may be stretched from an initial length to fit over the terminals of an electrical receptacle. The insulating band grips the terminals of the electrical receptacle for protecting against short circuiting of the electrical power connection.

18 Claims, 3 Drawing Sheets

U.S. PATENT DOCUMENTS

| | | | | |
|---|---|---|---|---|
| 5,977,485 | A | 11/1999 | Yoshimura et al. | |
| 6,025,560 | A | 2/2000 | De Buyst et al. | |
| 6,265,668 | B1 | 7/2001 | Liu | |
| 6,403,503 | B1 | 6/2002 | Weinberg | |
| 6,429,379 | B1 | 8/2002 | Yoshigi | |
| 6,559,386 | B1 | 5/2003 | Tagawa | |
| 6,576,838 | B2 | 6/2003 | Matsumura | |
| 6,590,163 | B1 | 7/2003 | Goto | |
| 6,664,477 | B2 * | 12/2003 | Fortin | 174/138 F |
| 2003/0028528 | A1 | 2/2003 | Christensen et al. | |
| 2003/0061365 | A1 | 3/2003 | White et al. | |
| 2003/0074367 | A1 | 4/2003 | Kaler et al. | |
| 2003/0101190 | A1 | 5/2003 | Horvitz et al. | |

* cited by examiner

ELECTRICAL INSULATING BANDS

This patent application claims priority to U.S. Provisional application, Ser. No. 60/508,667 filed on Oct. 6, 2003.

BACKGROUND OF THE INVENTION

A. Field of Invention

This invention pertains to the art of methods and apparatuses for insulating an electrical conduction device and more specifically to insulating the terminals of an electrical receptacle or device.

B. Description of the Related Art

In the art, electrical receptacles function to channel electrical power in various manners. Some receptacles provide for plug in power connection of electrical power, while other receptacles provide for selective control of electrical power through an electrical circuit. Typically, the electrical receptacle includes terminals that receive electrical conductors that provide for electrical current flow as is well known in the art. It is also known to provide receptacle boxes that house one or more electrical receptacles in a given application. In the installation of a receptacle, it is desirable to cover to the terminals of the receptacles such that a live electrical power connection does not electrically short circuit with another conducting material.

In the art, it is also known to cover the terminals of the electrical receptacle with electrical tape for added protection against short circuiting as mentioned above. Still, electrical tape is cumbersome to use; taking time to wrap and secure the tape around the terminals. Additionally, removal of the tape, for repair, maintenance of other purposes, leaves an adhesive residue on the terminals. What is needed is an easy to install and remove insulating band that electrically insulates the terminals of an electrical receptacle.

SUMMARY OF THE INVENTION

According to one aspect of the present invention, an insulating device, comprises a resiliently elastic insulating band member for use in electrically insulating the terminals of an associated electrical receptacle, the band member having a first insulating portion and a second retaining portion.

According to another aspect of the present invention, the insulating band member is an annular insulating band member.

According to another aspect of the present invention, the insulating band member is a contiguously formed insulating band member.

According to yet another aspect of the present invention, the first insulating portion has a thickness T1, wherein the second retaining portion has a thickness T2, and, wherein T1 is substantially greater than T2.

According to another aspect of the present invention, the ratio of T1/T2 is between 1.1 and 5.

According to another aspect of the present invention, the insulating band member has a characteristic width W, and, wherein the width W is sufficiently wide to cover the associated terminals of an associated electrical receptacle.

According to still yet another aspect of the present invention, an insulating strip member has a selectively variable length for use in fitting around the terminals of one or more electrical receptacles.

According to another aspect of the present invention, the insulating strip consists essentially of a resiliently elastic material.

According to another aspect of the present invention, the insulating strip is constructed from an elastic rubber.

According to another aspect of the present invention, the insulating strip is constructed from an elastic plastic.

According to yet another aspect of the present invention, the band member includes a first insulating portion having a thickness T1 and a second retaining portion having a thickness T2, and, wherein the thickness T1 is greater than the thickness T2.

According to another aspect of the present invention, a method of insulating an electrical outlet, the steps comprising:

providing an insulating band member, the band member being substantially resiliently elastic, the band member having a first un-stretched state and a second stretched state;

stretching the insulating band member from the first state to the second state;

placing the insulating band member over the associated terminals of an associated electrical receptacle; and, releasing the insulating band member thereby insulating the terminals of an associated electrical receptacle.

According to still yet another aspect of the present invention, the step of providing an insulating band member, comprises the step of:

providing an insulating band member, the band member being substantially resiliently elastic, the band member having a first un-stretched state and a second stretched state, the band member having an insulating portion and a retaining portion, wherein the insulating portion has a thickness T1, wherein the retaining portion has a thickness T2, and wherein the thickness T1 is substantially different in thickness than T2; and, wherein the step of placing the insulating band member over the associated terminals, comprises the step of:

placing the insulating band member over the associated terminals of an associated electrical receptacle, whereby the insulating portion of the insulating band is juxtaposed to the associated terminals of an associated electrical receptacle.

According to another aspect of the present invention, the step of stretching the insulating band member from the first state to the second state, comprises the step of:

manually stretching the insulating band member from the first state to the second state.

One important feature of the subject invention relates to the snug fit of the band over the receptacle, which holds the band in place without the use of fasteners, clips, adhesives or the like. The band is held in place via the gripping force of the elasticity of the band.

Another important feature of the band relates to the single band insulating device. The single band is easy to use by simply stretching the device and placing it over the electrical receptacle.

Yet another important feature of the band is that the snug fit of the band may prevent the terminals screws from unscrewing from the receptacle.

The subject invention includes a selectively elastically deformable band having good electrically insulating properties. The band may be stretched and placed over the terminals of an electrical receptacle. The band would then provide insulating protection from short circuiting the terminals of the receptacle with an electrical ground or other electrical conductors such as may be present in a gang box having multiple receptacles. The band may be removed in a similar manner as it was installed. In one embodiment, the band may be contiguously formed and have regions of increased thickness at certain portions of the band where the band comes into contact with the terminals of the receptacle. It is noted that the band may include labeling on an outer surface of the band, whereby safety labels, warning labels and/or electrical ratings may be applied. The labeling may be painted, embossed or placed on the band in any manner chosen with sound engineering judgment.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
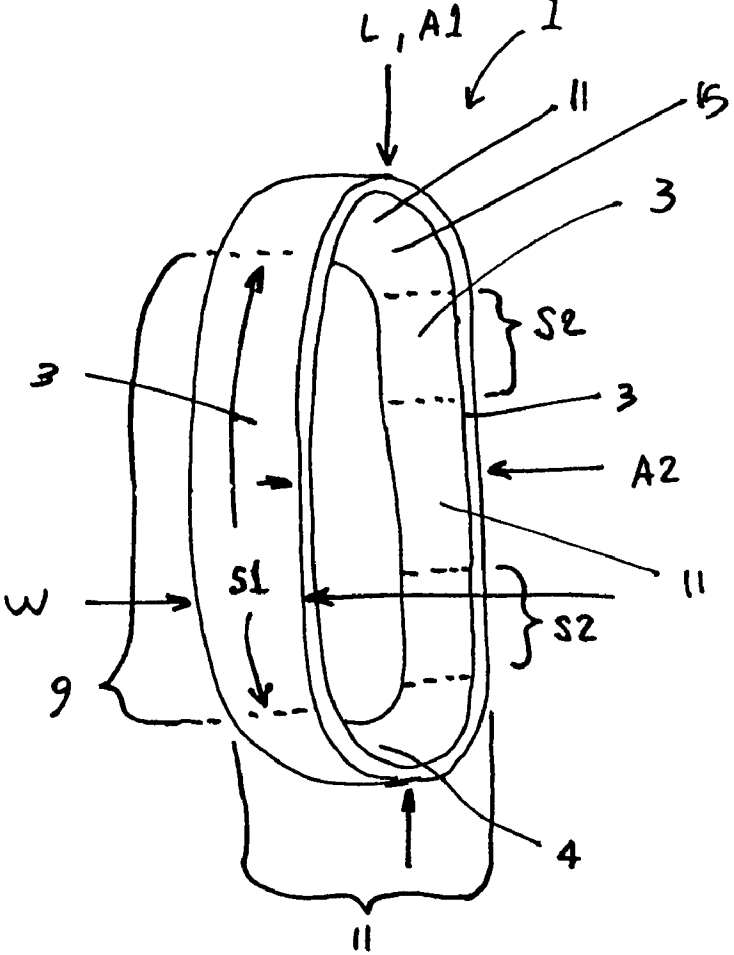
FIG. 1 is a perspective view of an insulating band.
Figure 3:
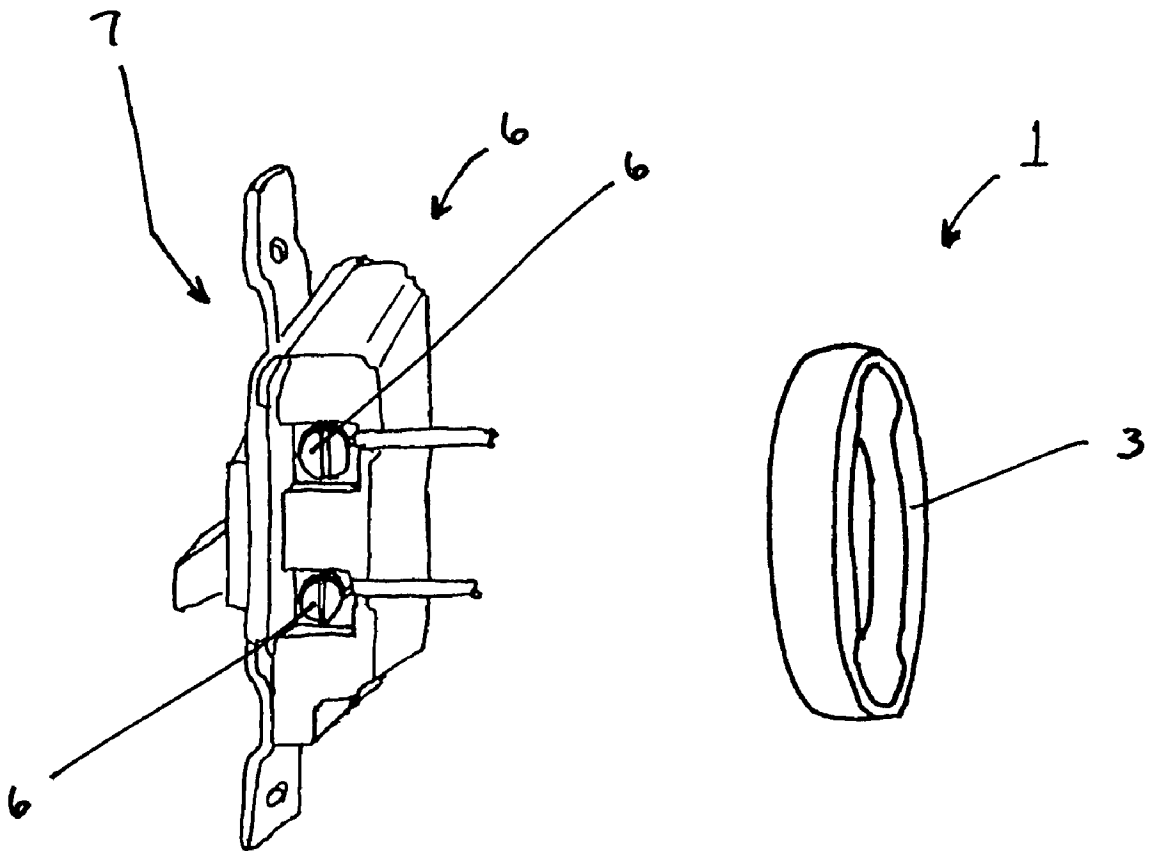
FIG. 3 is a perspective view of an insulating band proximate to an electrical device.
Figure 4:
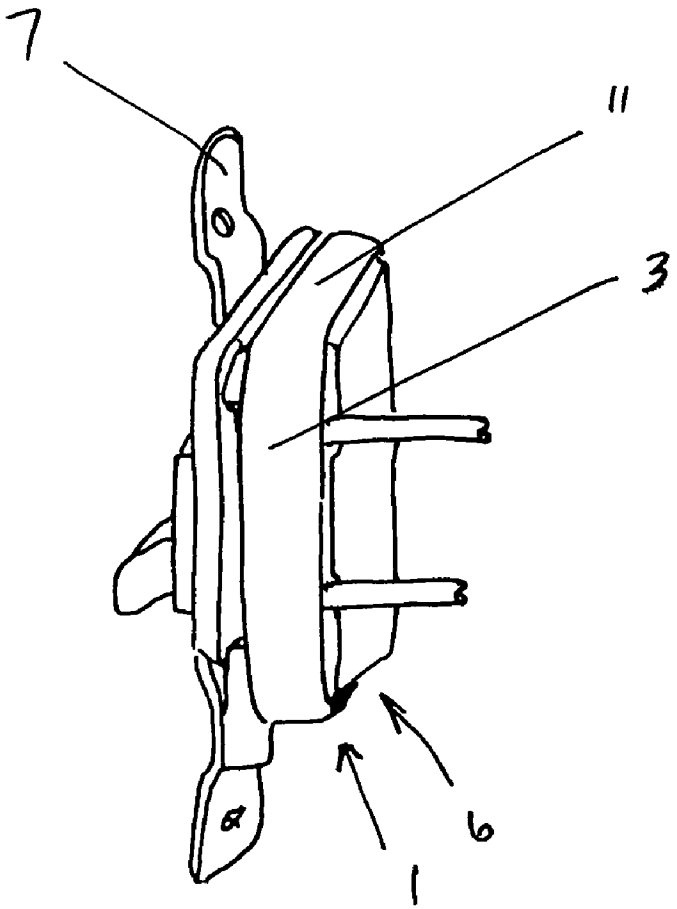
FIG. 4 is a perspective view of an insulating band placed onto an electrical device.

Referring now to the drawings wherein the showings are for purposes of illustrating a preferred embodiment of the invention only and not for purposes of limiting the same, FIG. 1 depicts an insulating device shown generally at 1. The insulating device 1 as shown in the figures may be an insulating band 1 or insulating band member 1. The insulating band 1 may be a single contiguously formed band. That is to say that the insulating band 1 may have no noticeable beginning or end point along the perimeter of the band 1. The band may also only be comprised of a single strip of insulating material, which makes device easy to install and disassemble. Any manner of contiguously forming the insulating band 1 may be chosen with sound engineering judgment. In one embodiment, the insulating band 1 may be annular in shape. The band 1 may also be generally elongate for use in fitting over a generally elongate electrical device as will be discussed further in a subsequent paragraph. In this manner, the insulating band 1 may have a characteristic major axis A1 and minor axis A2. From an end view, the band 1 may be elliptical in configuration. Alternatively, the end view of the band 1 may be square in shape. However, it is understood that any configuration of insulating band 1 may be chosen with sound engineering judgment.

With continued reference to FIG. 1, the insulating band 1 may have a width W. The width of the insulating band 1 may range from ½ inch up to 5 inches. In one embodiment, the insulating band 1 may be between ½ inch to 1½ inch. It is noted that any width of band 1 may be chosen with sound engineering judgment as is appropriate for the subject invention. However, the width of the insulating band 1 or insulating band member 1 may be any width sufficient to effectively insulate terminals 6 of an electrical device.

With continued reference to FIG. 1, the insulating band 1 may be constructed from a resiliently deformable material. One example of such material may include a rubber or rubber based material. Rubber based materials have excellent electrical insulating properties. As will be discussed further in subsequent paragraphs, the insulating band 1 may be placed over the electrical terminals of an electrically conductive device and may provide for superior insulating protection against short circuiting and/or personal injury. This may be important when the electrical device is placed adjacent or proximate to another electrically conductive item such as another similar electrical device, an electrical device housing, conductors, etc. Another example of resiliently deformable material may also include elastic plastic material. It is to be construed that any material that is resiliently deformable or resiliently elastic and that has good electrical insulating characteristics may be chosen with sound engineering judgment for use with the subject invention. In this manner, the insulating band may be extended from a first un-stretched state to a second stretched state. The insulating band may be stretched with an operator's hands or with a stretching tool, not shown, for use in placing on an electrical device. In this manner, the insulating band 1 may be selectively adjustable by stretching the band 1 to the desired length and placing the band on the target item to be insulated. It is noted at this point, that while the insulating band 1 has a natural un-stretched length L, the insulating band 1 has variable lengths in that it may be expanded for use on different size electrical receptacles or other devices. Therefore, one size band 1 may fit multiple size receptacles, or other similar devices having terminals.

Figure 2:
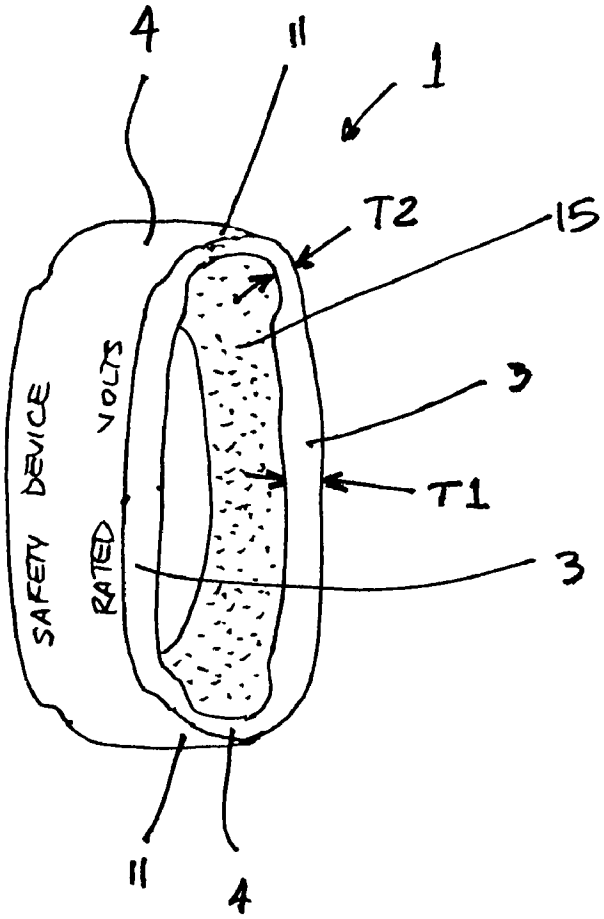
FIG. 2 is a perspective view of an alternate embodiment of an insulating band.

With reference again to FIG. 1 and now to FIG. 2, the insulating band 1 may have a first insulating portion 3 and a second retaining portion 4. The insulating portion 3 may be the region along the perimeter of the insulating band 1 that surrounds the terminals 6 of the electrical receptacle 7. By electrical receptacle, it may be meant, but is not limited to, an outlet, switches or any device with exposed electrical terminals. In one embodiment, the insulating portion 3 may be a contiguous section S1 of the insulating band 1 residing substantially on one side 9 of the insulating band 1. Alternately, the insulating band 1 may include multiple insulating sections S2 that may cover each individual terminal 6 of the electrical receptacle 7. However, any configuration of insulating portions may be chosen with sound engineering judgment. The second retaining portion 4 may be the section 11 of band material distal from the terminals 6 of the receptacle 7 when the band 1 is placed on the receptacle 7. In this way, the regions S1, S2 of band material that resides proximate to the terminals 6 may be the first insulating portion 3. Separately, the region 11 of band distal from the terminals 6 may be the retaining portion 4 of the band 1.

With reference now to FIGS. 1 and 2, the insulating portion 3 may have a thickness T1. The retaining portion 4 may have a thickness T2. In one embodiment, the thickness T1 may be greater than the thickness T2. This is important in that there may be very little clearance between the receptacle and the receptacle box, now shown, in which the receptacle is installed. While it may be desired to have a thinner band that fits into the area between the receptacle and the receptacle box, it may also be desirable to have a thicker insulating portion proximate to the terminals 6 of the receptacle. It is noted that in any manufacturing process of a band where a generally uniform thickness is desired, there may be nominal thickness variances between any two given points along the length of the band 1. By T1 being greater than T2 it is meant that the region comprising T2 is intentionally made to be thicker beyond nominal manufacturing thickness tolerances. However, in any manner, any degree of thickness difference between T1 and T2 may be chosen with sound engineering judgment. In one embodiment, the ratio of T1/T2 may be in the range of 1.1 to 5. Still, any ratio of T1/T2 may be chosen with sound engineering judgment. In this way, different thicknesses T1 for the insulating portion may be constructed for different electrical voltage/current/power ratings. Separately, the thickness T2 for the retaining portion may remain constant for any electrical voltage/current/power ratings.

With reference again to FIGS. 1 and 2, the band 1 may have an inner contacting surface 15. The inner surface 15 may be smooth. However, the inner surface 15 may also be textured. Any manner of texturing the inner surface 15 of the band 1 may be chosen with sound engineering judgment.

With reference now to all of the FIGURES, the operation of the subject invention will now be discussed. It will be noted that the subject invention relates to the short protection of an electrical receptacle, such as a wall outlet or switch. Additionally, it is noted that the subject invention relates to receptacles having small or large voltage ratings. The operator may take and insulating band 1 and selectively expand or stretch the band 1 from a first un-stretched to a second stretched state responsive to the size of an associated electrical receptacle 7. The operator may then position the band 1 such the insulating portion 3 is aligned with the terminals 6 of the receptacle 7. Subsequently, the operator may place the band 1 on the receptacle 7 and release the band 1 to a third terminal engaging state wherein the length of the band 1 in the third terminal engaging state may be longer then the first un-stretched state. In this way, the band 1 snuggly conforms to the receptacle 6 and does not easily come off of the receptacle because elastic band squeezes against the receptacle holding it firmly in place. It is noted that the operator may also use a tool, not shown, to stretch the band 1 during installation. For removal, the operator may grasp the band 1 and stretch the band to a second stretched state and remove the band 1 from engagement with the receptacle.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. An insulating device for insulating terminals of an electrical switch or receptacle, comprising:

a continuous elastic band around side surfaces of the switch or recptacle and forming a loop on a side circumference of the switch or receptacle and having at least one insulating portion for covering an wiring terminal of the wiring switch or receptacle, the insulation portion having a thickness, and at least one retaining portion having a thickness, and wherein the insulating portion thickness is greater than the retaining portion thickness.

2. The insulating device according to claim 1, wherein the device contains two or more insulating portions, and wherein the device contains two or more retaining portions.

3. The insulating device according to claim 2, wherein the ratio of the insulating portion thickness to the retaining portion thickness is between 1.1:1 and 5:1.

4. The insulating device according to claim 3, wherein an outer surface of the band includes labeling comprising a warning or an electrical rating or a combination thereof.

5. The insulating device according to claim 1, wherein the ratio of the insulating portion thickness to the retaining portion thickness is between 1.1:1 and 5:1.

6. The insulating device according to claim 5, wherein the band has a width of 0.5 inch to 5 inches.

7. The insulating device according to claim 6, wherein the device contains two or more insulating portions, and wherein the device contains two or more retaining portions.

8. The insulating device according to claim 7, wherein the band has a width of 0.5 inch to 1.5 inches.

9. An insulating device for insulating terminals of an electrical switch or receptacle, comprising:

a continuous elastic band around side surfaces of the switch or recptacle and forming a loop on a side circumference of the switch or receptacle and having at least one insulating portion for covering a wiring terminal of the switch or receptacle and at least one retaining portion, wherein an outer surface of the band includes labeling comprising a warning or an electrical rating or combination thereof wherein the insulating portion has a thickness which is greater than a thickness of the thickness of the retaining portion.

10. The insulating device according to claim 9, wherein the ratio of the insulating portion thickness to the retaining portion thickness is between 1.1:1 and 5:1.

11. The insulating device according to claim 10, wherein the band has a width of 0.5 inch to 5 inches.

12. The insulating device according to claim 11, wherein the device contains two or more insulating portions, and wherein the device contains two or more retaining portions.

13. The insulating device according to claim 12, wherein the band has a width of 0.5 inch to 1.5 inches.

14. An insulated receptacle or switch kit, comprising:

an electric receptacle or switch and a continuous elastic band around side surfaces of the switch or receptacle for insulating wiring terminals of the receptacle or switch, wherein the band has at least one insulating portion having a thickness and at least one retaining portion having a thickness, and wherein the insulting for covering a wiring terminal of the switch or receptacle portion thickness is greater than the retaining portion thickness.

15. The kit according to claim 14, wherein an outer surface of the band includes labeling comprising a warning or an electrical rating or a combination thereof.

16. The kit according to claim 14, wherein the device contains two or more insulating portions, and wherein the device contains two or more retaining portions.

17. The kit according to claim 16, wherein the ratio of the insulating portion thickness to the retaining portion thickness is between 1.1:1 and 5:1.

18. The kit according to claim 17, wherein an outer surface of the band includes labeling comprising a warning or an electrical rating or a combination thereof.

* * * * *